US009718108B2

(12) United States Patent
Latoria

(10) Patent No.: US 9,718,108 B2
(45) Date of Patent: Aug. 1, 2017

(54) POWERED BENDING TOOL

(71) Applicant: Huskie Tools, Inc., Glendale Heights, IL (US)

(72) Inventor: Joseph S. Latoria, West Chicago, IL (US)

(73) Assignee: Huskie Tools, Inc., Glendale Heights, IL (US)

( * ) Notice: Subject to any disclaimer, the term of this patent is extended or adjusted under 35 U.S.C. 154(b) by 219 days.

(21) Appl. No.: 14/597,758

(22) Filed: Jan. 15, 2015

(65) Prior Publication Data

US 2016/0074918 A1 Mar. 17, 2016

Related U.S. Application Data

(60) Provisional application No. 62/048,919, filed on Sep. 11, 2014.

(51) Int. Cl.
*B21D 11/12* (2006.01)
*B21D 7/06* (2006.01)

(52) U.S. Cl.
CPC ..... *B21D 11/12* (2013.01); *B21D 7/063* (2013.01)

(58) Field of Classification Search
CPC ..... B21D 7/02; B21D 7/022; B21D 7/024; B21D 7/04; B21D 7/063; B21D 7/08; B21D 11/12
See application file for complete search history.

(56) References Cited

U.S. PATENT DOCUMENTS 2,501,241 A * 3/1950 Shaw, Jr. ..... B21D 7/06 72/155
2,656,872 A * 10/1953 Mann ..... B21D 7/022 72/219
3,236,082 A * 2/1966 Beck ..... B21D 7/022 228/17.5
4,532,787 A * 8/1985 Caporusso ..... B21D 7/024 72/149
4,785,650 A * 11/1988 Lusty ..... B21D 7/063 33/529
5,284,040 A * 2/1994 Beelen ..... B21D 7/024 72/149
5,390,522 A * 2/1995 Dircks ..... B21D 7/063 72/217

(Continued)

*Primary Examiner* — Edward Tolan
(74) *Attorney, Agent, or Firm* — Wood, Phillips, Katz, Clark & Mortimer

(57) ABSTRACT

A powered bending tool comprises a portable drive housing including a handle and having a powered drive gear. A bracket is secured to the housing defining a pivot connection spaced from the drive gear. A driven gear is pivotally connected to the bracket at the pivot connection and operatively engages the drive gear. A center guide is connected to the bracket at the pivot connection. A support is operatively connected to the bracket at one side of and spaced from the pivot connection. An arm has a near end pivotally connected to the bracket at the pivot connection and a distal end having an arm guide at another side of the pivot connection relative to the guide. The arm is selectively engeagable by the driven gear to be rotated therewith. In use, a rod is positioned below the center guide and above the arm guide and a support, and the drive gear drives the driven gear to pivot the arm so that the arm guide deforms the rod as it engages the center guide at a bend point.

19 Claims, 7 Drawing Sheets

(56) References Cited

U.S. PATENT DOCUMENTS

| | | | | |
|---|---|---|---|---|
| 6,026,668 | A * | 2/2000 | Oda | B21D 7/022 72/217 |
| 6,079,246 | A * | 6/2000 | Caporusso | B21D 7/024 72/157 |
| 7,024,905 | B1 * | 4/2006 | Carlson | B21D 7/022 72/217 |
| 7,900,495 | B2 | 3/2011 | Latoria | |
| 8,171,765 | B2 * | 5/2012 | Rusch | B21D 7/063 72/149 |
| 8,511,131 | B2 | 8/2013 | Latoria | |
| 2009/0188291 | A1 * | 7/2009 | Itrich | B21D 7/063 72/149 |
| 2015/0298192 | A1 * | 10/2015 | Paris | B21F 1/002 72/372 |

* cited by examiner

POWERED BENDING TOOL

CROSS REFERENCE TO RELATED APPLICATIONS

This application claims priority of provisional application No. 62/048,919, filed Sep. 11, 2014.

BACKGROUND OF THE INVENTION

Field of the Invention

This invention relates to a bending tool and more particularly, to a powered rod bending tool.

Background Art

Rod shaped material, such as ground rod, rebar, or the like, is conventionally supplied as a straight, elongate rod. Prior to installation, it is often necessary to provide a bend. This may be accomplished with a manually operated tool which provides a desired bend in the rod. Also, powered bending tools have been used, although not always satisfactorily. A conduit bender, or the like, may also be used.

A typical conduit bender includes a handle and a head. The head is of one piece construction including an arcuate shoe with a laterally concave groove for supporting the conduit. A hook is proximate one end of the shoe for engaging a conduit received in the channel. The handle is secured to the head and is generally positioned in a radial line relative to the arcuate shoe. The conduit rests on a support surface with the hook engaging the conduit. The handle is forced downwardly to roll the shoe onto the conduit with the hook pulling the conduit upwardly to form a bend. However, a conduit bender is used to provide a more gradual bend to prevent the thinwall conduit from collapsing. Rod material may require a sharper bend.

Such a conduit bender requires the presence of a support surface for the conduit and the strength to force the handle to produce the bend. Also, it is necessary for the person using the conduit bender to frequently start and stop the bending operation to observe the bender relative to the conduit to see if the appropriate bending angle has been achieved.

The known powered rod benders may damage the rod, particularly ground rods with copper bonded surface. Waste resulting from such damage is expensive.

The present invention is directed to further facilitating the operation of bending a rod or similar product.

SUMMARY OF THE INVENTION

There is disclosed herein a powered bending tool for rods and the like which can be used with one handed operation.

In accordance with a first aspect, a powered bending tool comprises a portable drive housing including a handle and having a powered drive gear. A bracket is secured to the housing defining a pivot connection spaced from the drive gear. A driven gear is pivotally connected to the bracket at the pivot connection and operatively engages the drive gear. A center guide is connected to the bracket at the pivot connection. A support is operatively connected to the bracket at one side of and spaced from the pivot connection. An arm has a near end pivotally connected to the bracket at the pivot connection and a distal end having an arm guide at another side of the pivot connection relative to the guide. The arm is selectively engeagable by the driven gear to be rotated therewith. In use, a rod is positioned below the center guide and above the arm guide and a support guide, and the drive gear drives the driven gear to pivot the arm so that the arm guide deforms the rod as it engages the center guide at a bend point.

It is a feature that the driven gear may have a select radius and the support guide is spaced from the pivot connection an amount greater than the select radius.

It is a further feature that the driven gear may comprise a substantially semi-circular gear having peripheral gear teeth operated by the drive gear. The substantially semi-circular gear may have a generally radially extending edge selectively engaging the arm during a select portion of the rotation of the drive gear. The arm may have a rearwardly extending projection in a path of movement of the semi-circular gear.

It is another feature that the bracket may comprise an arcuate guard having a near end secured to the housing proximate the drive gear and a distal end including the support. The arcuate guard may include indicia identifying a plurality of bend angles and the driven gear may have an indicator. Rotational position of the driven gear selectively positions the indicator proximate the indicia to identify actual rod bend angle.

It is a feature that the center guide and/or the arm guide and/or the support may comprise a spool.

It is yet another feature that a battery is removably connected to the handle to provide a battery operated tool.

There is disclosed in accordance with another aspect a powered rod bending tool comprising a portable drive housing including a handle having a powered drive gear. A bracket is secured to the housing defining a pivot connection spaced from the drive gear. The bracket includes a shaft supporting a center spool. A driven gear is pivotally connected to the bracket of the pivot connection and operatively engages the drive gear. A guide spool is operatively connected to the bracket at one side of and spaced from the pivot connection. An arm has a near end pivotally connected to the bracket at the pivot connection and a distal end having an arm spool at another side of the pivot connection relative to the guide spool. The arm is selectively engageable by the driven gear to be rotated therewith. In use, a rod is positioned below the center spool and above the arm spool and the guide spool and the drive gear drives the driven gear to pivot the arm so that the arm spool deforms the rod as it engages the center guide at a bend point.

Further features and advantages of the invention will be readily apparent from the specification and from the drawings.

BRIEF DESCRIPTION OF THE DRAWINGS

FIG. 6A is a perspective view of a plate of the operating head of

FIG. 2;

DETAILED DESCRIPTION OF THE PREFERRED EMBODIMENT

Figure 1:
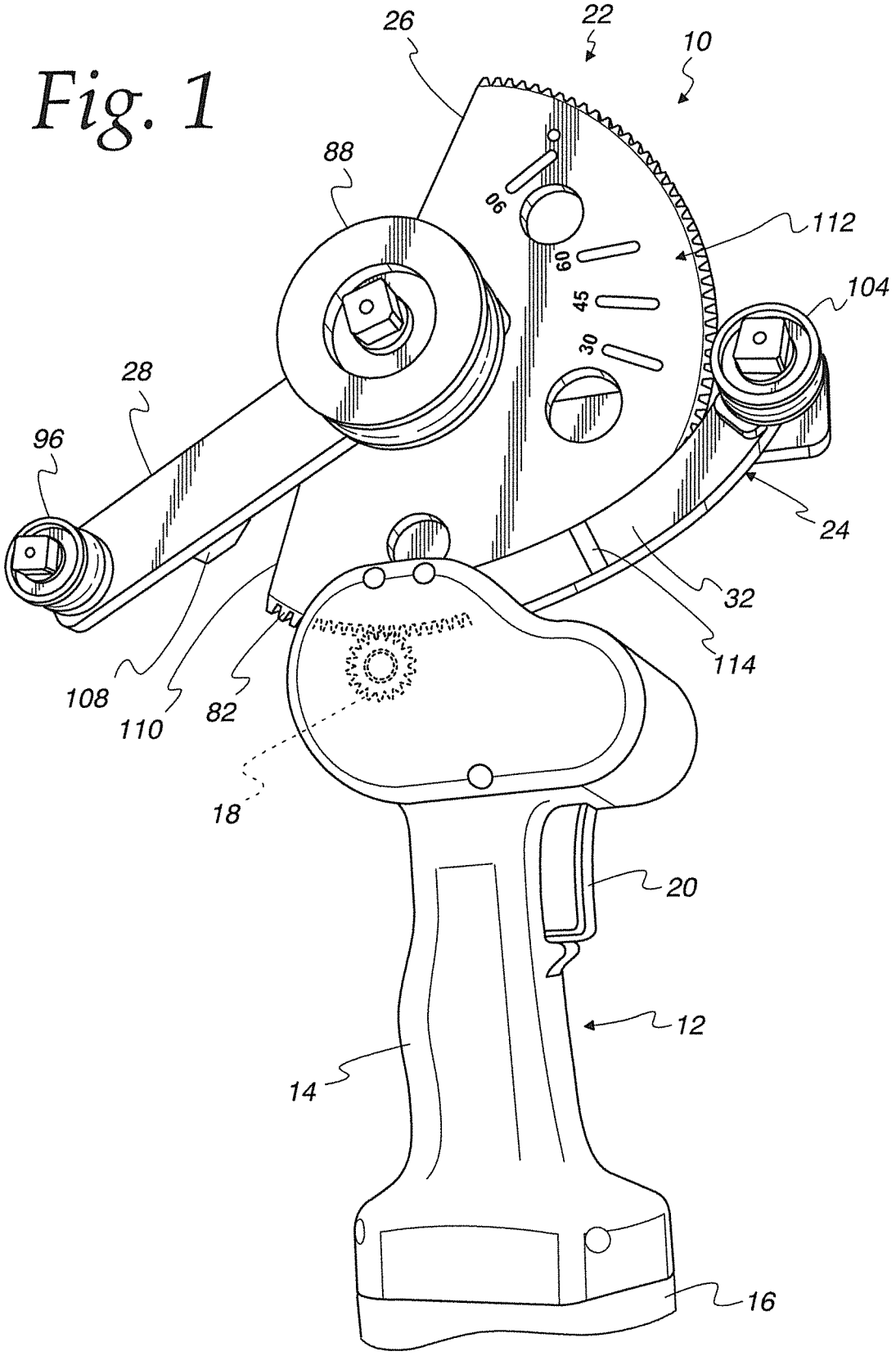
FIG. 1 is a front perspective view of a powered bending tool.
Figure 2:
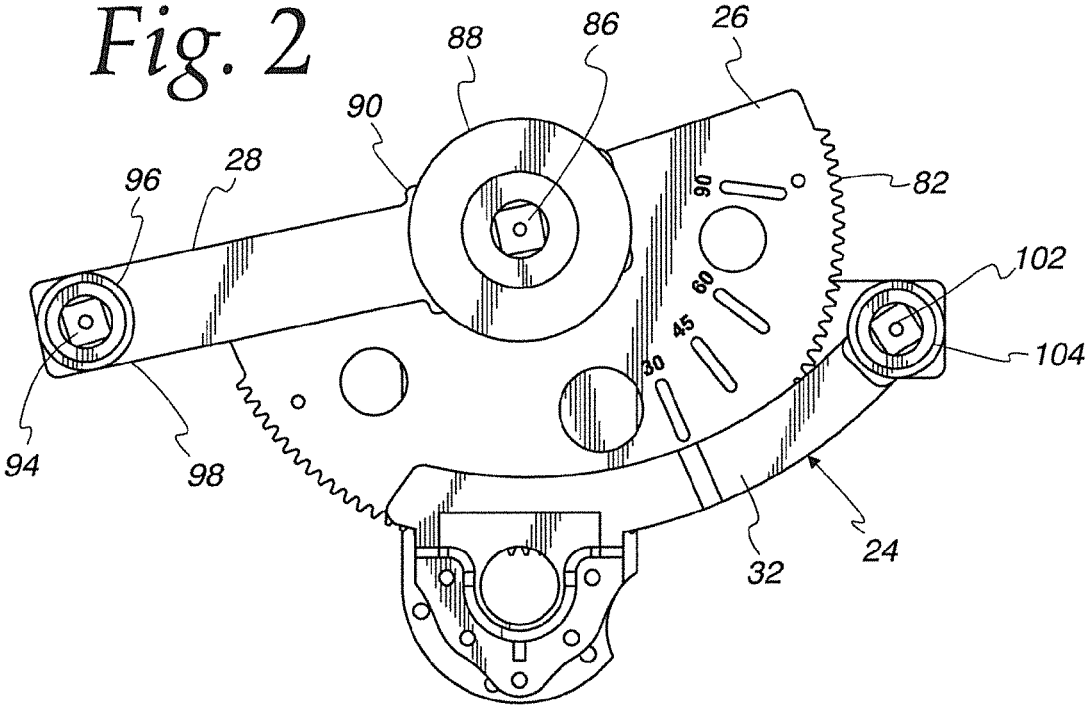
FIG. 2 is a front elevation view of an operating head of the tool of FIG. 1 in a first operating position.
Figure 3:
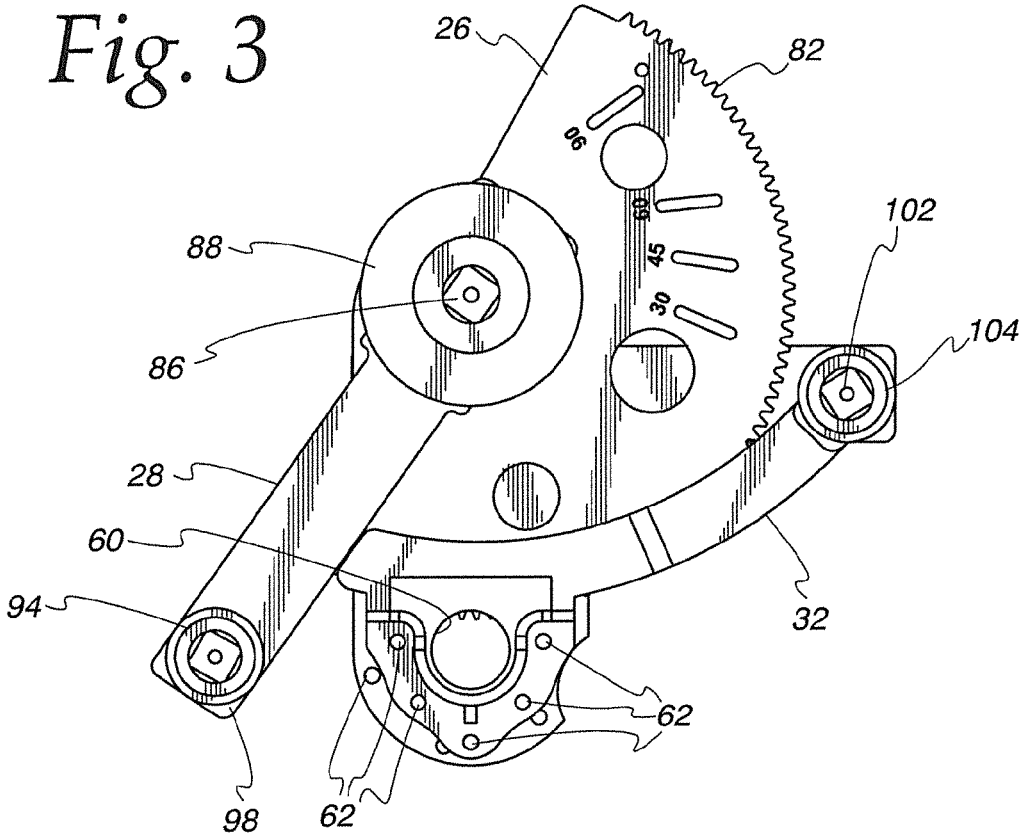
FIG. 3 is a view similar to FIG. 2 with the operating head in an initial operating position.

Referring to FIG. 1, a powered bending tool 10 is illustrated. The powered bending tool 10 comprises a battery powered device which enables a user using only one hand to accurately and simply bend a rod shaped material to a desired angle. Such rod shaped material may comprise ground rod, rebar, or the like. It could also be used to bend heavy electrical cables and the like where a sharp bend is desired.

The powered bending tool 10 includes a portable drive housing 12 similar to a conventional power tool, such as a drill. The housing 12 includes a gripping handle 14. A battery 16 is removably mounted to the housing 12 and powers a conventional battery operated drive (not shown) in the housing 12 and having a drive gear 18 (shown in phantom). The drive uses a trigger switch 20 and converts electrical power from the battery 16 to turn the drive gear 18 in a conventional manner. For example, the drive may be generally similar to a conventional cordless drill, except that a chuck is replaced with the drive gear 18. Alternatively, the drive could be operated off a 100 volt AC supply and include a power cord, as will be apparent. The switch 20 is movable between a center off position and up and down positions for forward and reverse rotational movement of the drive gear 18, as described below.

An operating head 22 is operatively secured to the housing 12. The operating head 22 comprises a bracket assembly 24, a blade 26 and an elongate arm 28. Referring also to FIGS. 2-5, the bracket assembly 24 comprises a plate 30, a guard 32 and a support 34. The plate 30 is shown in detail in FIG. 6A. The guard 32 is shown in detail in FIG. 6B. The support 34 is shown in detail in FIG. 6C. The blade 26 is shown in detail in FIG. 6D.

The plate 30 is generally oval shaped and is thicker at a top half 38 than at a lower half 40. The lower half 40 includes an enlarged circular opening 42 surrounded by a plurality of smaller openings 44, only one of which is numbered. The upper half 38 includes a pivot opening 46 which defines a pivot connection. Three smaller openings 48 are in line below the through opening 46.

The guard 32 comprises an arcuate arm 50 having a near end 54 and a distal end 58. A body 52 extending downwardly proximate the near end 54. A through opening 56 is provided at the distal end 58. The body 52 includes a cylindrical through bore 60. A plurality of small openings 62 are provided in the body 52 surrounding the bore 60. The through bore 60 is of a similar size to the plate circular opening 42 to be coaxial therewith and the small openings 62 are aligned with select ones of the plate openings 44.

The support 34 comprises an elongate plate 64 including a through opening 66 proximate a first end 68 and three aligned openings 70 proximate a second end 72. Spacing between the three aligned openings 70 is similar to spacing between the plate openings 48, see FIG. 6A.

Figure 4:
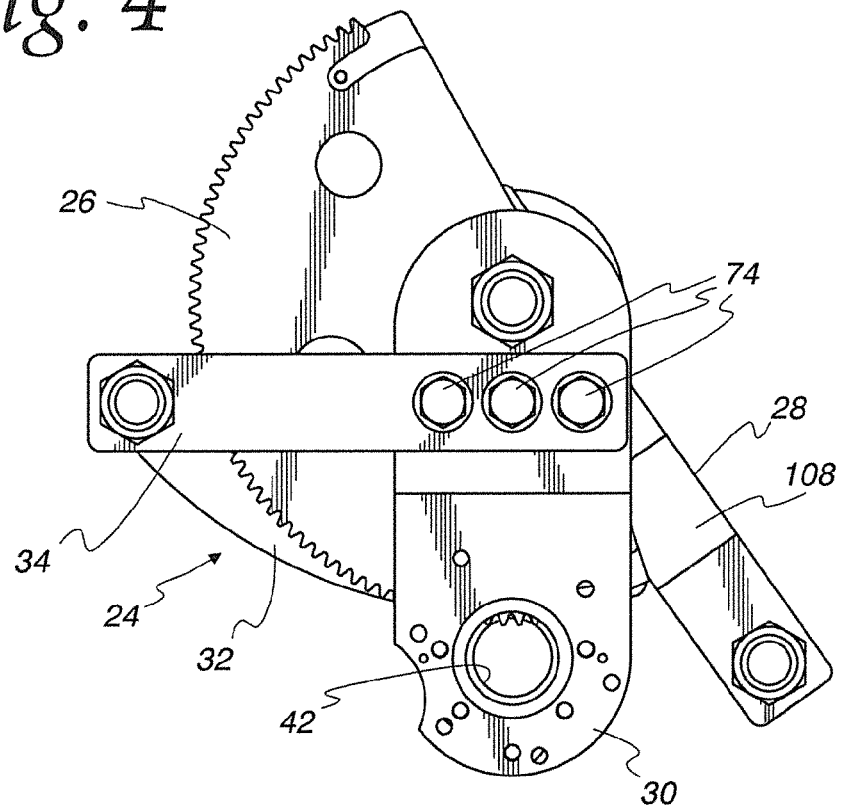
FIG. 4 is a rear view of the operating head of FIG. 3.

The support 34 is secured to the plate 30 by aligning the respective openings 70 and 48 through which fasteners 74 extend, see FIG. 4. The guard 32 is secured to the plate 30 by aligning the guard small openings 62 with the blade openings 44 and using suitable fasteners (not shown). As such, the guard through bore 60 is coaxial with the blade opening 42.

Figure 6A:
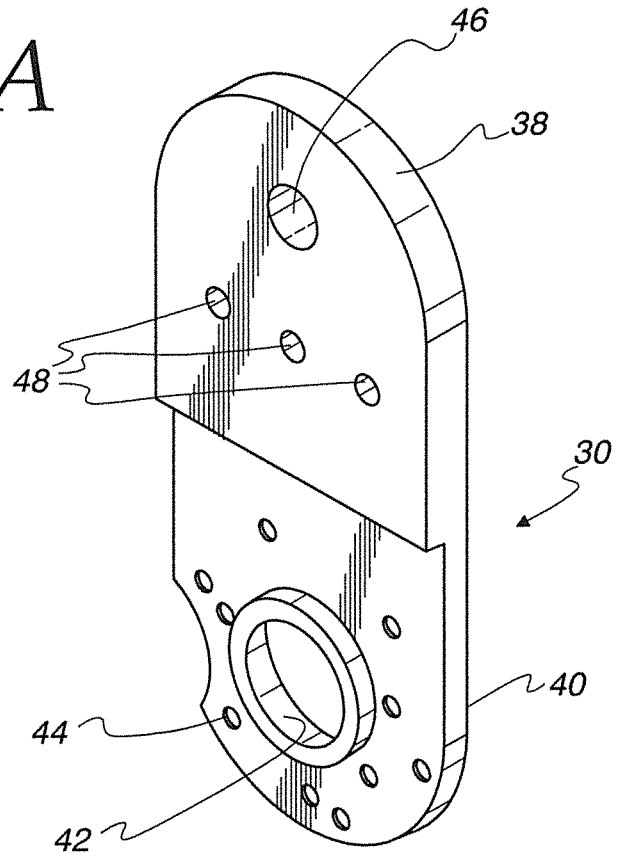
Figure 6B:
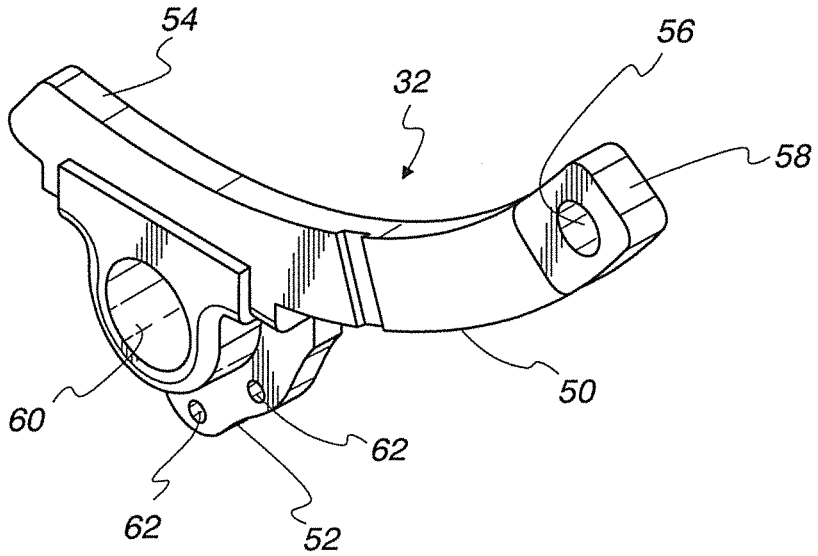
FIG. 6B is a perspective view of a guard of the operating head of FIG. 2.
Figure 6C:
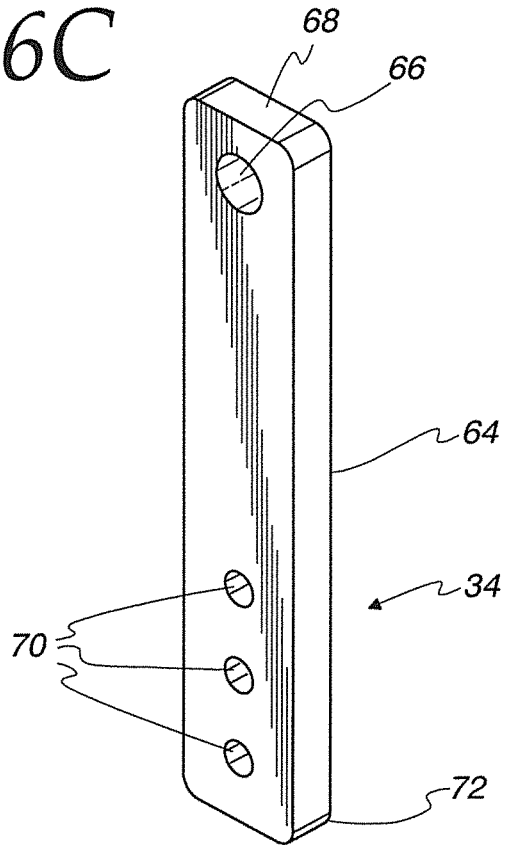
FIG. 6C is a perspective view of a support of the operating head of FIG. 2.
Figure 6D:
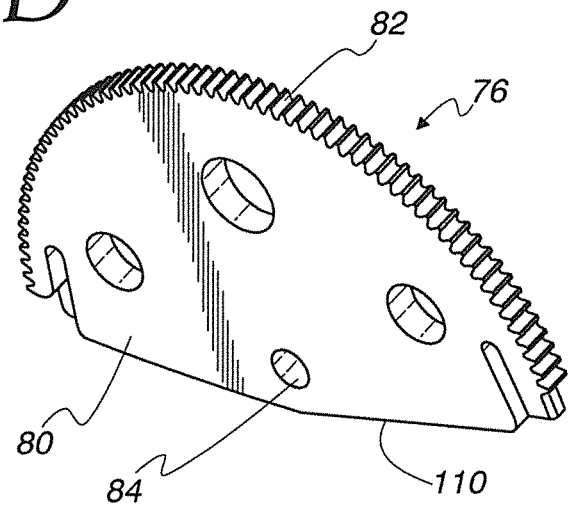
FIG. 6D is a perspective view of a blade of the operating head of FIG. 2.

The blade 26 is shown in detail in FIG. 6D. The blade 26 comprises a substantially semi-circular plate 80 having peripheral gear teeth 82 so that the blade 26 defines a driven gear. A pivot opening 84 is located at a radial center of the semi-circular plate 80.

The blade 26 is rotationally mounted to the bracket assembly 24. The blade pivot opening 84 is aligned with the plate pivot opening 46. A bolt 86 extends through a center guide 88, an opening (not shown) in a near end 90 of the arm 28, through the blade pivot opening 84 and through the plate opening 46 where it is secured with a nut 92, see FIG. 5. As such, the blade 26 is pivotal about the bolt 86 with the gear teeth 82 visible through the guard bore 60 and likewise the plate opening 42. The operating head 22 is fixedly mounted using fasteners (not shown) to the portable drive housing 12 so that the opening 42 and bore 60 are coaxial with the drive gear 18 which thereby engages the driven gear teeth 82, as illustrated in FIG. 1.

An arm bolt 94 mounts an arm guide 96 to a distal end 98 of the arm 28. The bolt 94 is received in a nut 100, see FIG. 5.

Figure 5:
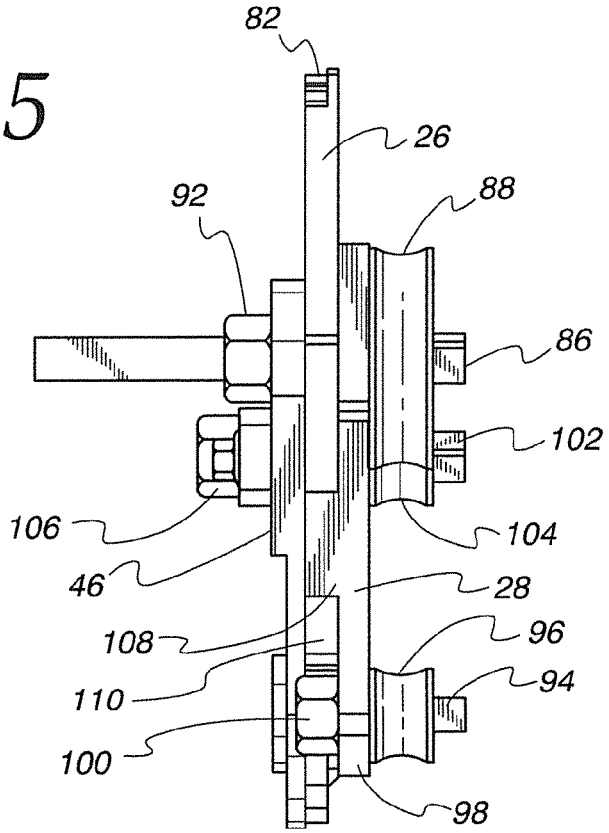
FIG. 5 is a side elevation view of the operating head of FIG. 3.

A bolt 102 mounts a support guide 104 to the bracket assembly 24 by passing through the guard distal opening 56 and the support opening 66 and then received in a bolt 106, see FIG. 5.

Each of the center guide 88, the arm guide 96 and the support guide 104 may comprise a spool or the like pivotally mounted by the respective bolts 86, 94 and 102. These guides 88, 96 and 104 are each adapted to include a concave circumferential profile (see FIG. 5) for a rod to be selectively received thereon. The size of the guides may be selected according to size of the rod material to be worked on.

The arm 28 includes a projection 108 extending rearwardly therefrom, as shown in FIG. 5. The arm 28 is in a different plane from the blade 28, as illustrated, except for the projection 108 which is coplanar with the blade 26.

As described, the operating head 22 is mounted to the portable drive housing 12. The blade 26 includes a radius from the pivot opening 84 to the teeth 82 which is less than spacing between the support guide 104 and the pivot connection 46. The blade 26 has a generally radial extending edge 110 selectively engaging the arm projection 108, as described below. The blade 26 includes indicia 112 identifying a plurality of bend angles and the guard 32 includes an indicator 114. The rotational position of the blade 26 selectively aligns the indicia 112 relative to the indicator 114 to indicate a bend angle.

Figure 7:
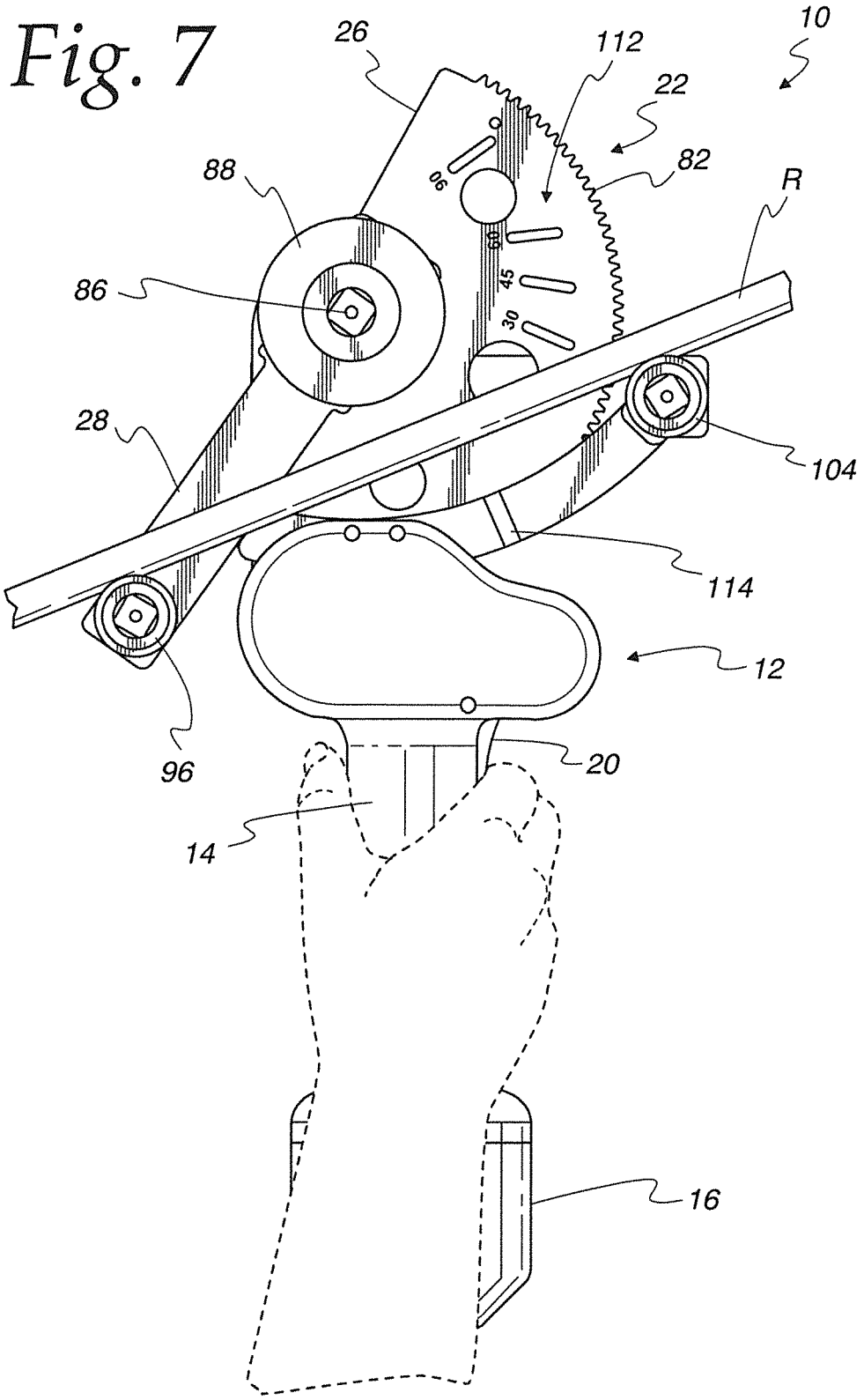
FIG. 7 is a front elevation view illustrating use of the bending tool in a starting position.
Figure 8:
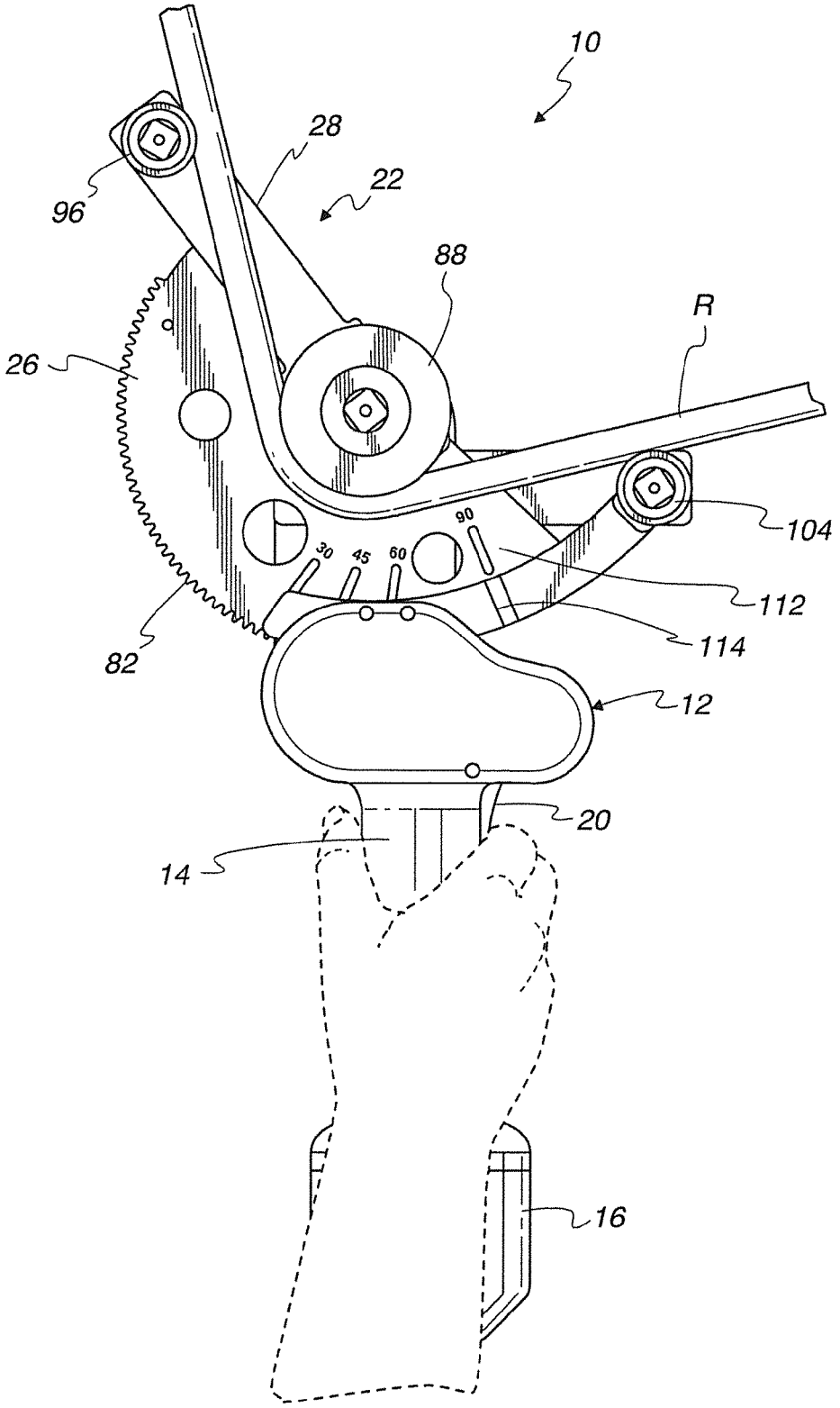
FIG. 8 is a view similar to FIG. 7 illustrating the tool after deforming a rod to a 90° angle bend.

The use of the bending tool 10 is described relative to FIGS. 7 and 8. Prior to use, the blade 26 is generally positioned as illustrated in FIG. 7. The arm 28 is free to rotate about the pivot connection, represented by the bolt 86. However, due to gravity, the arm 28 will rest in a generally downward position as illustrated. As such, the arm guide 96 and support guide 104 are on different sides of and below the center guide 88. A rod R is then positioned atop the arm guide 96 and the support guide 104 below the center guide 88. The user then depresses the switch 20. The drive, under battery power, turns the drive gear 18, see FIG. 1, to turn the blade 26 in the clockwise direction. As is apparent, location of the support guide 104 is fixed relative to the housing 12, as is the center guide 88 (which is at the pivot connection). The arm projection 108 engages the blade edge 110. Thus, rotation of the blade 26 causes the arm 28 to likewise rotate in a clockwise direction. This effectively raises the left end of the rod R until the rod R engages the underside of the center guide 88 at a desired bend point. Continued rotation of the blade 26 bends the rod R about the center guide 88, as generally shown in FIG. 8. When the desired angle has been reached, then the trigger 20 is released and the bend angle will be illustrated by the position of the indicia 112 relative to the indicator 114. In the illustrated embodiment, the indicator 114 is aligned with the 90° indicia as the rod R is bent to a 90° angle. Once the desired angle has been reached, then the trigger 20 is actuated in reverse to rotate the blade 26 in the counter-clockwise direction to relieve the rod R so that it can be removed.

Thus, as described, a powered bending tool 10 comprises a portable drive housing 12 including a handle 14 and having a powered drive gear 18. A bracket assembly 24 is secured to the housing 12 and defines a pivot connection at the bolt 86 spaced from the drive gear 18. A driven gear in the form of the blade 26 is pivotally connected to the bracket assembly 24 at the pivot connection and operatively engages the drive gear 18. A center guide 88 is connected to the bracket assembly at the pivot connection. A support guide 104 is operatively connected to the bracket assembly 24 at one side of and spaced from the pivot connection 86. The arm 28 has a near end 90 pivotally connected to the bracket assembly at the pivot connection 86 and a distal end 98 having an arm guide 94 at another side of the pivot connection relative to the support guide 104. The arm 28 is selectively engageable by the driven gear 26 to be rotated therewith. In use, a rod R is positioned below the center guide 88 above the arm guide 94 and the support guide 104. The drive gear 18 drives the driven gear 26 to pivot the arm 28 so that the arm guide 94 deforms the rod as it engages the center guide 88 at a bend point.

Although the powered conduit bending tool 10 is described in connection with bending rod material, the device can be more generally thought of as a powered bender for bending any rod like material intended to be formed in this manner. Thus, use of the term rod herein is intended to refer to any such work piece, as will be apparent.

Thus, in accordance with their invention, there is provided a portable, powered bender of the size of a conventional portable power tool enabling rods of different types to be bent with a one handed operation.

The invention claimed is:

1. A powered bending tool, comprising:

a portable drive housing including a handle and having a powered drive gear;

a bracket assembly secured to the housing and defining a pivot connection spaced from the drive gear;

a driven gear pivotally connected to the bracket assembly at the pivot connection and operatively engaging the drive gear;

a center guide connected to the bracket assembly at the pivot connection;

a support guide operatively connected to the bracket assembly at one side of and spaced from the pivot connection;

an arm having a near end pivotally connected to the bracket assembly at the pivot connection and a distal end having an arm guide at another side of the pivot connection relative to the support guide, the arm selectively engageable by the driven gear to be rotated therewith, wherein, in use, a rod is positioned below the center guide and above the arm guide and the support guide, and the drive gear drives the driven gear to pivot the arm so that the arm guide deforms the rod as it engages the center guide at a bend point.

2. The powered bending tool of claim 1 wherein the driven gear has a select radius and the support guide is spaced from the pivot connection an amount greater than the select radius.

3. The powered bending tool of claim 1 wherein the driven gear comprises a substantially semi-circular gear having peripheral gear teeth operated by the drive gear.

4. The powered bending tool of claim 3 wherein the substantially semi-circular gear has generally radially extending edge selectively engaging the arm during a select portion of rotation of the drive gear.

5. The powered bending tool of claim 4 wherein the arm has a rearwardly extending projection in a path of movement of the semi-circular gear.

6. The powered bending tool of claim 1 wherein the bracket comprises an arcuate guard having a near end secured to the housing proximate the drive gear and a distal end including the support.

7. The powered bending tool of claim 6 wherein the arcuate guard includes indicia identifying a plurality of bend angles and the driven gear has an indicator, and rotational position of the driven gear selectively positions the indicator proximate the indicia to identify actual rod bend angle.

8. The powered bending tool of claim 1 wherein the center guide comprises a spool.

9. The powered bending tool of claim 1 wherein the arm guide comprises a spool.

10. The powered bending tool of claim 1 wherein the support comprises a spool.

11. The powered bending tool of claim 1 wherein a battery is removably connected to the handle to provide a battery operated tool.

12. A powered bending tool comprising:

a portable drive housing including a handle and having a powered drive gear;

a bracket secured to the housing defining a pivot connection spaced from the drive gear, the bracket including a shaft supporting a center spool;

a driven gear pivotally connected to the bracket at the pivot connection and operatively engaging the drive gear;

a guide spool operatively connected to the bracket at one side of and spaced from the pivot connection;

an arm having a near end pivotally connected to the bracket at the pivot connection and a distal end having an arm spool at another side of the pivot connection relative to the guide spool, the arm selectively engageable by the driven gear to be rotated therewith, wherein, in use, a rod is positioned below the center spool and above the arm spool and the guide spool, and the drive gear drives the driven gear to pivot the arm so that the arm spool deforms the rod as it engages the center guide at a bend point.

13. The powered bending tool of claim 12 wherein the driven gear has a select radius and the guide spool is spaced from the pivot connection an amount greater than the select radius.

14. The powered bending tool of claim 12 wherein the driven gear comprises a substantially semi-circular gear having peripheral gear teeth operated by the drive gear.

15. The powered bending tool of claim 14 wherein the substantially semi-circular gear has generally radially extending edge selectively engaging the arm during a select portion of rotation of the drive gear.

16. The powered bending tool of claim 15 wherein the arm has a rearwardly extending projection in a path of movement of the semi-circular gear.

17. The powered bending tool of claim 12 wherein the bracket comprises an arcuate guard having a near end secured to the housing proximate the drive gear and a distal end including the guide spool.

18. The powered bending tool of claim 17 wherein the arcuate guard includes indicia identifying a plurality of bend angles and the driven gear has an indicator, and rotational position of the driven gear selectively positions the indicator proximate the indicia to identify actual rod bend angle.

19. The powered bending tool of claim 12 wherein a battery is removably connected to the handle to provide a battery operated tool.

* * * * *